United States Patent [19]

Swain et al.

[11] Patent Number: 4,492,527

[45] Date of Patent: Jan. 8, 1985

[54] WOBBLE PLATE PISTON PUMP

[75] Inventors: James C. Swain; David L. Thomas, both of Columbus, Ohio

[73] Assignee: Diesel Kiki Co., Ltd. (Japanese Corp.), Tokyo, Japan

[21] Appl. No.: 467,413

[22] Filed: Feb. 17, 1983

[51] Int. Cl.[3] ..... F04B 1/26

[52] U.S. Cl. ..... 417/222; 417/270; 92/12.2

[58] Field of Search ..... 417/269, 222; 92/12.2

[56] References Cited

U.S. PATENT DOCUMENTS

| | | | |
|---|---|---|---|
| 3,292,554 | 12/1966 | Hessler | 417/269 |
| 3,611,879 | 10/1971 | Alderson | 91/507 |
| 4,175,915 | 11/1979 | Black | 417/222 |
| 4,425,837 | 1/1984 | Livesay | 417/269 |

*Primary Examiner*—William L. Freeh

*Attorney, Agent, or Firm*—Charles S. McGuire

[57] ABSTRACT

A wobble plate piston pump in which means for holding the slipper shoes in close proximity with the wobble plate comprises a first retainer member in the form of an annular plate, loosely fitted on the drive shaft and formed with a plurality of through bores circumferentially arranged in the vicinity of its outer periphery and loosely receiving therethrough trunk portions of the slipper shoes swivellingly engaging the pistons, the retainer member being movable in directions substantially parallel to the wobble plate as the slipper shoes slide on or in close proximity to the wobble plate, a second retainer member having a hollow tubular portion loosely fitted through the first retainer member and unremovably fitted in a central bore formed in the wobble plate and a flanged portion holding the first retainer member on flanged portions of the slipper shoes to keep the latter in close proximity with the wobble plate.

6 Claims, 3 Drawing Figures

WOBBLE PLATE PISTON PUMP

BACKGROUND OF THE INVENTION

This invention relates to a wobble plate piston pump adapted particularly for use as a compressor in an air conditioning system, and more particularly to means for holding the piston shoes in close proximity with the wobble plate during simultaneous swinging and rotational motion of the latter.

A variable delivery hydraulic pump has been proposed by U.S. Pat. No. 4,157,233 for instance, which comprises a drive shaft, a plurality of cylinders circumferentially arranged around the drive shaft and extending substantially parallel to the axis of same, pistons disposed to reciprocate in the cylinders, a wobble plate engaging the drive shaft for rotation in unison therewith, slipper shoes disposed in slidable contact or close proximity with the wobble plate at locations corresponding to the cylinders, and piston rods secured to the pistons and disposed in spherical engagement with the slipper shoes. According to this proposed hydraulic pump, an annular retainer member is mounted on the wobble plate in relation concentric therewith and slightly spaced from its sliding side surface. The retainer member has a plurality of through bores formed in the vicinity of its outer periphery at locations corresponding to the piston rods and loosely receiving therethrough trunk portions of the slipper shoes which in turn have their flanged portions interposed between the retainer member and the wobble plate in a manner slidable or close proximity with the latter. As the wobble plate rotates, the slipper shoes are guided along the peripheral edges of the above through bores in the retainer member to slide over or close proximity to the sliding side surface of the wobble plate. In the proposed arrangement, when the wobble plate is tilted relative to the drive shaft, a slipper shoe engaging a piston which is in its top dead center or in its vicinity is biased radially outward, and a slipper shoe engaging a piston which is in its bottom dead center or in its vicinity is biased radially inward. Thus, as the wobble plate rotates while maintaining its inclined position, the slipper shoes are radially moved relative to the center of the wobble plate so that the peripheral edges of the through bores in the retainer member are hit against the trunk portions of the slipper shoes to impede their radial movement. To prevent this, the above through bores should have a sufficiently large diameter, which, however, necessitates designing the flanged portions of the slipper shoes correspondingly large in diameter to prevent disengagement of the slipper shoes from the wobble plate through the through bores. Therefore, the conventional arrangement has the disadvantage that the slipper shoes are inevitably large in size, and the wobble plate is correspondingly large in size, resulting in a large overall size of the whole piston pump.

OBJECTS AND SUMMARY OF THE INVENTION

It is the object of the invention to provide a wobble plate piston pump in which the retainer member and the slipper shoes can be compact in size, permitting a reduction in the overall size.

It is a further object of the invention to provide a wobble plate piston pump in which the slipper shoes are positively held in close proximity with the wobble plate or allowed to slide on the wobble plate.

The present invention provides means for holding the slipper shoes in slidable contact or in close proximity with the wobble plate, which comprises a first retainer member in the form of an annular plate, having a first through bore formed in its central portion, and a plurality of second through bores circumferentially arranged in the vicinity of its outer periphery, each being slightly larger in diameter than the trunk portions of the slipper shoes. The first retainer member is loosely fitted at its first through bore on the drive shaft. The second through bores loosely receive therethrough the respective trunk portions of the slipper shoes so that the first retainer member moves in directions substantially parallel to an associated side surface of the wobble plate as the slipper shoes move parallel to the wobble plate. The slipper shoe holding means also comprises a second retainer member which has a hollow tubular portion loosely fitted through the first through bore of the first retainer member and unremovably fitted in a central bore formed in central bore formed in the wobble plate, and a flanged portion formed integrally with the hollow tubular portion and having an outer diameter larger than that of the first through bore of the first retainer member but so small that the flanged portion does not interfere with the movement of the slipper shoes. The flanged portion of the second retainer member holds the first retainer member in slidable contact or close proximity with the flanged portions of the slipper shoes to enable the first retainer member to keep the flanged portions of the slipper shoes in slidable contact or close proximity with the associated side surface of the wobble plate.

The above and other objects, features and advantages of the invention will be more apparent from the ensuing detailed description taken in connection with the accompanying drawings in which:

DETAILED DESCRIPTION

Figure 1:
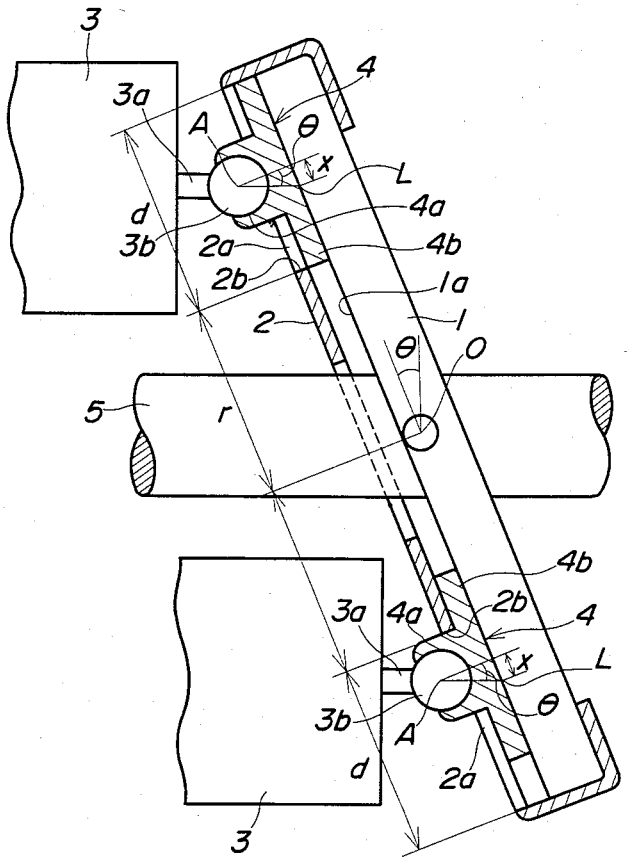
FIG. 1 PRIOR ART
FIG. 1 is a fragmentary view, partly in section, of a conventional wobble plate piston pump, showing a manner of engagement of piston rods, slipper shoes and the wobble plate.

Referring first to FIG. 1, there is illustrated an arrangement of pistons, slipper shoes and a wobble plate in a conventional wobble plate piston pump. An annular retainer member 2 is supportedly mounted on a wobble plate 1 in concentricity therewith, with its outer peripheral edge having an L-shaped section embracing the peripheral edge of the wobble plate 1, and in a manner permitting rotation of the wobble plate 1 relative thereto. The retainer member 2 is formed with a plurality of through bores 2*a* circumferentially arranged in the vicinity of its outer periphery at locations corresponding to piston rods 3*a* secured to pistons 3. Loosely fitted through these through bores 2*a* at their trunk portions 4*a* are a plurality of slipper shoes 4. The trunk portions 4*a* have recesses spherically joined with spherical ends 3*b* of the pistons 3. The slipper shoes 4 have flanged portions 4b larger in diameter than the trunk portions 4a and held in slidable contact or close proximity with a sliding side surface 1a of the wobble plate 1 by means of the retainer member 2.

Since the piston rods 3a are rigidly secured to the pistons 3, as the wobble plate 1 rotates in a position tilted at an angle $\theta$ relative to the axis of a drive shaft 5, the piston rods 3a each have its axis move along an oval orbital path L on the sliding side surface 1a of the wobble plate 1, and simultaneously a slipper shoe 4 engaging a piston 3 which is in its top dead center is tilted outwardly of the oval orbital path L through an angle $\theta$ about the center A of its corresponding spherical end 3b, whereas a slipper shoe 4 engaging a piston 3 which is in its bottom dead center is tilted inwardly of the orbital path L through an angle $\theta$ about the center A of its corresponding spherical end 3b. That is, the slipper shoe 4 engaging the piston 3 in its top dead center is biased outwardly of the oval orbital path L by a distance $\chi$ corresponding to the angle of inclination of the slipper shoe 4, whereas the slipper shoe 4 engaging the piston 3 in its bottom dead center is biased inwardly of the orbital path L by the distance $\chi$. However, since the retainer member 2 is concentrically mounted on the wobble plate 1 and held stationary relative thereto, the distance r between a radially innermost portion 2b of each through bore 2a in the retainer member 2 and the center of the same member has to be set at such a value that when a slipper shoe 4 moves to its extreme innermost position on the wobble plate 1, the radially innermost portion 2b of the bore 2a does not interfere with the movement of the slipper shoe 4. Further, the diameter of each through bore 2a should be designed so larger that when the slipper shoe 4 moves to its extreme outer position, a radially outermost portion of the through bore 2a does not interfere with the movement of the slipper shoe 4. In addition, to prevent slippage of the slipper shoes 4 out of their associated through bores 2a, the flanged portions 4b of the slipper shoes 4 should each have a much larger diameter than an area mechanically required of the flanged portion 4b, that is, an area required for obtaining sufficient wear resistance and lubrication of the slipper shoe 4. However, since the retainer member 2 embraces at its outer peripheral edge the peripheral edge of the wobble plate 1 as previously noted, the diameter of the wobble plate should be large enough to permit required radial movement of the large-sized slipper shoes 4, resulting in a large radial size of the piston pump.

Figure 2:
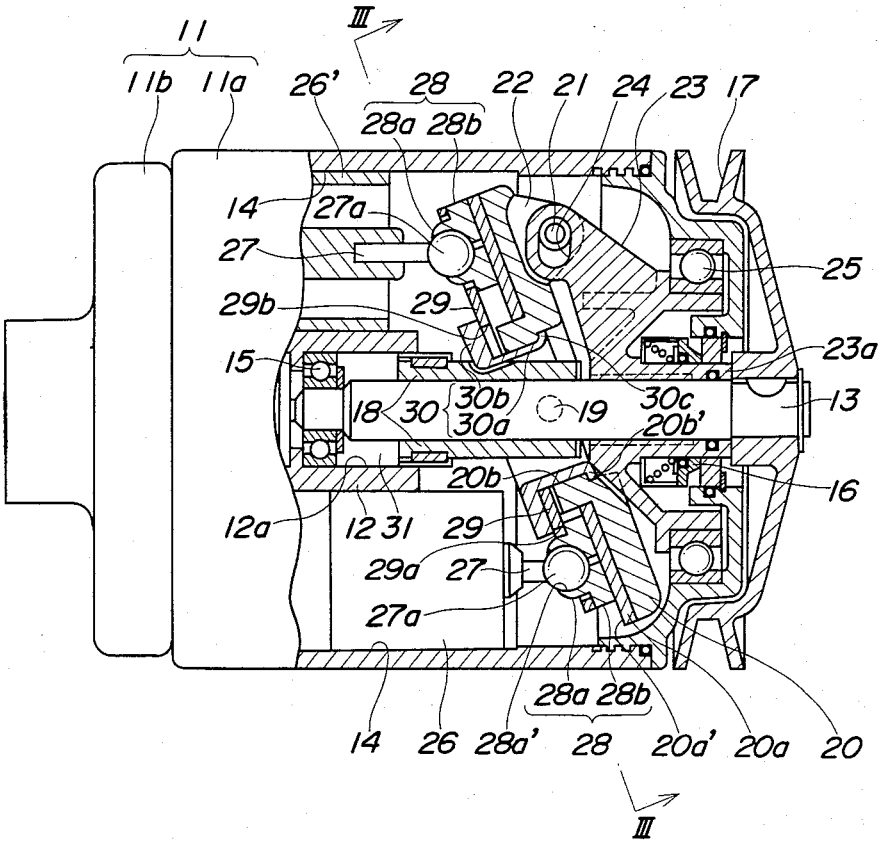
FIG. 2 is a longitudinal sectional view showing a wobble plate piston pump according to an embodiment of the present invention, in which the wobble plate is tilted to its maximum angle.
Figure 3:
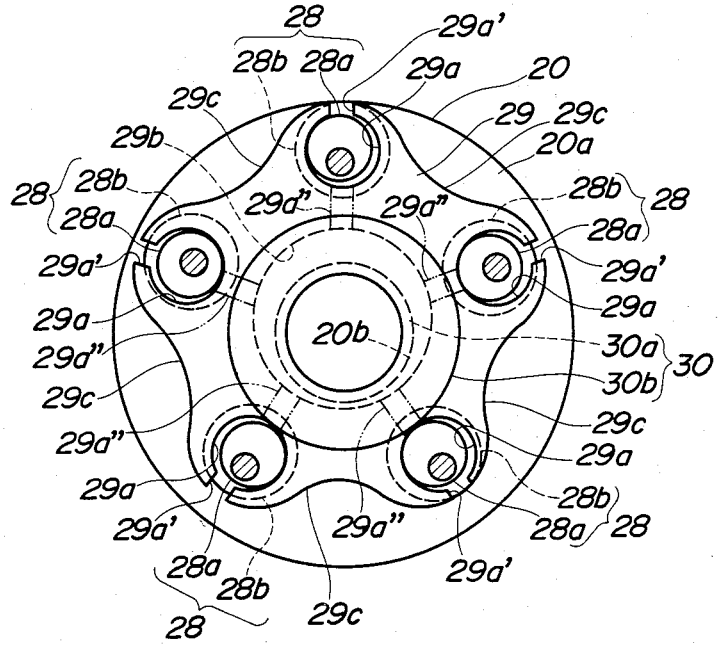
FIG. 3 is a sectional view taken along line III—III in FIG. 2.

The present invention will now be described with reference to FIGS. 2 and 3 in which a preferred embodiment of the invention is illustrated. Reference numeral 11 designates a housing which is formed by a cylindrical casing 11a and a cylinder head 11b combined together. A cylinder block 12 is disposed within the cylindrical casing 11a, which may be formed integrally with the casing 11a and is formed therein with a plurality of cylinders 14 circumferentially arranged around a drive shaft 13 and extending substantially parallel to the axis of same. The drive shaft 13 is disposed substantially along the longitudinal axis of the housing 11, with its one end journalled by a ball bearing 15 mounted in a central closed bore 12a formed in the cylinder block 12 and its other end extending through a front portion of the casing 11a which is located on the right side as viewed in FIG. 2, and carrying a pulley 17 rigidly fitted thereon. A slider 18 in the form of a sleeve is fitted on the drive shaft 13 for axial sliding movement thereon, on which are secured a pair of trunnion pins 19 extending at right angles to the drive shaft 13. A wobble plate 20 in the form of a disc is loosely fitted on the slider 18 at its central through bore 20b and pivotally engages with the latter in a manner that the trunnion pins 19 are rotatably fitted in bores, not shown, formed in the inner peripheral wall of the central through bore 20b of the wobble plate 20. Thus, as the slider 18 axially moves along the drive shaft 13, the wobble plate 20 is moved along the same shaft in unison with the slider 18 to be tilted about the trunnion pins 19 with respect to the drive shaft 13. In the illustrated embodiment, a disc plate 20' is secured on or slidably applied on a side surface of the wobble plate 20, which is formed of a material having a high wear resistance.

A pivot 21 is mounted on the wobble plate 20 by means of a bracket 22, at a side of the wobble plate 20 remote from the cylinder block 12 at a location in the vicinity of a point on an extension of the axis of a particular one of pistons 26 received in the cylinders 14. The pivot 21 is engaged in a guide slot 24 formed in a pivot hub 23 which is rigidly secured at its boss 23a on the drive shaft 13 for rotation in unison with the latter, so that rotation of the drive shaft 13 is transmitted to the wobble plate 20 through the members 23, 21, 22 and 19 to cause corresponding rotation of the wobble plate 20 and the wobble plate 20 can be tilted about the pivot fulcrum 21 along an orbital path executed by the trunnion pins 19 as the slider 18 moves along the drive shaft 13. The pivot hub 23 is journalled by a large-sized ball bearing 25 mounted in the casing 11a in a manner that the front portion of the drive shaft 13 is substantially supported by the casing 11a by means of the ball bearing 25 via the pivot hub 23. A sealing assembly 16 is slidably fitted on the boss 23a of the pivot hub 23 and secured to the casing 11a.

On the other hand, the aforementioned pistons 26 are received in the cylinders 14 for reciprocating motions therein, which cylinders are arranged in an array concentric to the axis of the drive shaft 13. A piston rod 27 is secured integrally on each piston 26 and extends along an extension of the axis of same toward the wobble plate 20. The piston rods 27 each have a tip formed integrally with a sphere 27a which is spherically engaged in a bore 28a' formed in a trunk portion 28a of a corresponding slipper shoe 28 for allowing the slipper shoe 28 to swing about the center of the sphere 27a. The slipper shoes 28 each have a flanged portion 28b positively held in slidable contact or close proximity with a sliding side surface 20a of the wobble plate 20 even during rotation of the latter, by the following means: As seen in FIG. 3 showing a view taken along the line III—III in FIG. 2, a first retainer member 29 in the form of an annular plate is formed with five through bores 29a circumferentially arranged in the vicinity of its outer peripheral edge at locations corresponding to respective ones of the slipper shoes 28 spherically engaging the spheres 27a on the tips of the piston rods 27, each through bore 29a being slightly larger in diameter than the trunk portion 28a of its associated slipper shoe 28.

The illustrated piston pump is a five-cylinder type. The first retainer member 29 is also formed with a central through bore 29b considerably larger in diameter and encircling the drive shaft 13, the slider 18 and a second retainer 30. The slipper shoes 28 have their trunk portions 28a loosely fitted in their respective through bores 29a of the first retainer member 29 and their flanged portions 28b disposed in slidable contact or close proximity with the same member 29, respectively, in such a manner that as the slipper shoes 28 slidingly move on the wobble plate 20, the first retainer member 29 can be freely moved in directions substantially parallel to the sliding side surface 20a of the wobble plate 20. The first retainer member 29 has outer peripheral edges 29c intermediate between adjacent through bores 29a radially inwardly concaved to reduce the whole weight of the member 29. Each of the through bores 29a has a narrow cut-out portion 29a' opening in the outer peripheral surface of the first retainer member 29, through which portion the corresponding piston rod 27 engaged in the corresponding slipper shoe 28 is inserted into the through bore 29a in putting the slipper shoe-piston rod assembly and the first retainer member 29 together. The through bores 29a may each alternatively have a cut-out portion 29a'', indicated by the chain lines in FIG. 3, opening in the inner peripheral surface of the first retainer member 29, for the same purpose as the cut-out portion 29a'.

A second retainer member 30 is provided for holding the first retainer member 29 on the slipper shoes 28 to keep the slipper shoes 28 in slidable contact or close proximity with the sliding side surface 20a of the wobble plate 20. The second retainer member 30 comprises an axially extending hollow tubular portion 30a loosely fitted in the central through bore 29b of the first retainer member 29 and also unremovably fitted in the central through bore 20b of the wobble plate 20 with its radially outwardly deformed flange 30c engaged by a stepped shoulder 20b' formed on the central through bore 20b of the wobble plate 20, and a radially flanged portion 30b formed integrally on an end of the hollow tubular portion 30a and larger in diameter than the central through bore 29b of the first retainer member 29 but so small in diameter that it does not interfere with movement of the associated slipper shoes 28 on the wobble plate 20. The second retainer member 30 has its flanged portion 30b disposed to hold the first retainer member 29 in slidable contact or close proximity with the slipper shoes 28 while allowing an inner fringe portion of the first retainer member 29 surrounding its central bore 29b to slide on the flanged portion 30b.

The slider 18 has its one end portion slidably fitted in the central blind bore 12a in the cylinder block 12, an end face of which defines a hydraulic pressure chamber 31 in cooperation with inner walls of the central bore 12a. The slider 18 can be axially moved along the drive shaft 13 by supplying a hydraulic operating oil from a hydraulic pressure source, not shown, into the above hydraulic pressure chamber 31 or draining the oil therefrom.

The operation of the wobble plate piston pump according to the invention constructed above will now be described: When the pulley 17 is rotated by driving force transmitted thereto via a belt, not shown, from an external drive means, not shown, the drive shaft 13 is rotated in unison with the pulley 17. If the hydraulic control device comprised of the hydraulic pressure chamber 31, etc. is not operated on this occasion, the slider 18 is biased to its leftmost position as viewed in FIG. 2, by means of a spring, not shown, which urges the slider 18, to keep the wobble plate 20, which is rotatable about the pivot 21, in its neutral position. The pistons 26 are arranged to be positioned in their top dead centers in the respective cylinders 14 also when the wobble plate 20 is in its neutral position. Rotation of the wobble plate 20 in its neutral position does not cause any stroke motions of the pistons 26, and accordingly neither suction nor delivery of pumping fluid takes place. When the hydraulic control device is actuated to move the slider 18 in the rightward direction as viewed in FIG. 2, the wobble plate 20 becomes titled about the pivot 21. At the same time, the bottom dead center of each of the pistons 26 is displaced rightward to increase the stroke length of the piston. When the wobble plate 20 is in its maximum tilted position, the pistons 26 each have a maximum stroke length to obtain a maximum piston displacement. Since the pistons 26 are in their top dead centers even when the wobble plate 20 is in its neutral position as stated above, the pistons 26 can each start its stroke motion at its top dead center where the compressing space in the corresponding cylinder 14 has a very small volume when the angle of inclination of the wobble plate 20 is small. Thus, sufficient compression efficiency can be obtained even when a small amount off luid is pumped.

Alternatively of the aforementioned hydraulic control device comprised of the hydraulic pressure chamber 31, etc., tilting of the wobble plate 20 may be controlled by varying the pressure of fluid filled within the housing 11 (the pressure of blow-by gas leaked through the cylinders 14 if the pump is used as a compressor for air conditioning systems) to control the balance between the reaction force of the compressing fluid and the above fluid pressure in the housing 11 which acts upon the pistons 26 as back pressure. The pressure chamber 31 could also alternatively be acted upon by the discharge pressure. By thus varying the inclination of the wobble plate 20 relative to the axis of the drive shaft 13, the pumping capacity can be varied from zero to a minimum in a stepless manner.

During the above operation of the pump, the first retainer member 29 and the second retainer member 30 cooperatively act to hold the slipper shoes 28, which are spherically coupled to the respective piston rods 27, in positive slidable contact or close proximity with the wobble plate 20 rotating in an inclined position so as to cause piston strokes. More specifically, the first retainer member 29, which has its through bores 29a loosely engaging the trunk portions 28a of the slipper shoes 28 while holding the flanged portions 28b of same in slidable contact or close proximity with the wobble plate 20, is moved in a free manner in directions substantially parallel to the sliding side surface 20a of the wobble plate 20 in unison with sliding movement of the slipper shoes 28 on the wobble plate 20. Since the first retainer member 29 is freely movable relative to the wobble plate 20 within a range of movement allowed by the slipper shoes 28, as distinct from the conventional retainer member 2 shown in FIG. 1, which is held stationary relative to the wobble plate, the through bores 29a formed in the first retainer member 29 need not have a large diameter for prevention of their interference with the moving slipper shoes. The through bores 29a have only to be slightly larger in diameter than the respective trunk portions 28a of the slipper shoes 28 so as to allow the individual slipper shoes 28 located at different circumferential positions to be biased or displaced relative to the wobble plate 20 with different amounts of displacement to each other when the wobble plate 20 is tilted, as clearly shown in FIG. 3. However, since the differences between the amounts of displacement of the individual slipper shoes 28 are very small, the through bores 29a need not be designed so large in diameter.

The second retainer member 30 engages at its hollow tubular portion 30*a* with the wobble plate 20 in a manner unremovable therefrom, with its flanged portion 30*b*, which has an outer diameter having such a value as does not interfere with the movement of the slipper shoes 28 as previously noted, held in slidable contact or close proximity with the inner fringe portion of the first retainer member 29 encircling the central through bore 29*b*. The central through bore 29*b* of the first retainer member 29 has an inner diameter so sufficient as does not interfere with the hollow tubular portion 30*a* of the second retainer member 30 during movement of the first retainer member 29 in unison with the moving slipper shoes 29. Therefore, the second retainer member 30 slides at its flanged portion 30*b* on the inner fringe portion of the first retainer member around its central through bore 29*b*, while holding the member 29 in sliding contact or close proximity with the slipper shoes 28, even when the member 29 is moving within a large range of motion. Thus, the slipper shoes 28 are positively held in sliding contact or close proximity with the sliding side surface 20*b* of the wobble plate 20 during rotation of the wobble plate 20.

As stated above, the through bores 29*a* of the first retainer member 29 can be slightly larger in diameter than the trunk portions 28*a* of the slipper shoes 28 and the flanged portions 28*b* of the slipper shoes 28 can be correspondingly small in diameter so that the slipper shoes 28 cannot slip out of their respective through bores 29*a*, making the slipper shoes 28 compact in size. In addition to the compact size of the slipper shoes, the first retainer member 29 is held in engagement with the wobble plate 20 by the second retainer member 30 supporting the first retainer member 29 at its central portion, and therefore the radial movement of slipper shoes 28 is not obstructed by the first retainer member 29 as distinct from the conventional arrangement previously described, thus making it possible to design the wobble plate 20 small in diameter, resulting in a small overall radial size of the piston pump. Furthermore, since the first retainer member 29 not only has small-sized through bores 29*a* but also is radially movable together with the moving slipper shoes 28, the outer diameter of the member 29 can be rather small, it can have such a small degree of warpage as can positively hold the slipper shoes 28 in smoothly slidable contact or close proximity with the wobble plate 20 even during rotation of the latter.

While a preferred embodiment has been described, variations thereto will occur to those skilled in the art within the scope of the present inventive concepts which are delineated by the following claims.

What is claimed is:

1. In a wobble plate piston pump including a housing a drive shaft rotatably mounted in said housing, a cylinder block fixedly disposed in said housing and formed therein with a plurality of cylinders circumferentially arranged around said drive shaft and extending substantially parallel to the axis of said drive shaft pistons received in said cylinders for reciprocating motions therein, piston rods secured integrally to said pistons, a wobble plate having a central through bore through which said drive shaft extends, said wobble plate being rotatable in unison with rotation of said drive shaft and tiltable relative to said drive shaft, slipper shoes each having a flanged portion disposed in slidable contact or close proximity with a side surface of said wobble plate and a trunk portion engaging a corresponding one of said piston rods, and means for holding said slipper shoes in slidable contact or close proximity with said wobble plate, the improvement comprising in said slipper shoe holding means: a first retainer member in the form of an annular plate and substantially flat over whole side surfaces thereof, said first retainer member having a first through bore formed in a central portion thereof, and a plurality of second through bores circumferentially arranged in the vicinity of an outer periphery thereof, each being slightly larger in diameter than said trunk portions of said slipper shoes, said first retainer member being loosely fitted at said first through bore on said drive shaft, said second through bores loosely receiving therethrough respective ones of said trunk portions of said slipper shoes; a second retainer member having an axially extending tubular portion loosely fitted through said first through bore in said first retainer member and unremovably fitted in said central through bore of said wobble plate, said tubular portion being smaller in diameter than said first through bore in said first retainer member to provide a radial space between said first and second retainer members, and a radially flanged portion formed integrally with said tubular portion and having an outer diameter substantially larger than that of said first through bore of said first retainer member but so small that said flanged portion of said second retainer member does not interfere with the sliding movement of said slipper shoes on said wobble plate, said flanged portion of said second retainer member being disposed to slide on an inner fringe portion of said first retainer member encircling said first through bore in a manner permitting radial and circumferential movements of said first retainer member in said radial space; and means for holding said second retainer member at a predetermined axial location relative to said wobble plate, said first retainer member being held at said inner fringe portion thereof in slidable contact with said flanged portion of said second retainer member by said second retainer member holding means so that said first retainer member is held in slidable contact or close proximity with said flanged portions of said slipper shoes to keep said flanged portions of said slipper shoes in slidable contact or close proximity with said sliding side surface of said wobble plate, whereby during rotation of said wobble plate, said first retainer member is movable in unison with the sliding movement of said slipper shoes, in directions radial and circumferential relative to said wobble plate and substantially parallel to said sliding side surface of said wobble plate.

2. The wobble plate piston pump as claimed in claim 1, wherein said first retainer member has outer peripheral edges intermediate between adjacent ones of said second through bores thereof radially inwardly concaved along a substantial length of said outer peripheral edges.

3. The wobble plate piston pump as claimed in claim 1, wherein said second retainer member holding means comprises a radially outwardly deformed flange formed on an end of said tubular portion of said second retainer member remote from said flanged portion thereof and engaged by said wobble plate at said central through bore.

4. The wobble plate piston pump as claimed in claim 1 or claim 2, wherein said second through bores of said first retainer member each have a cut-out portion extending therefrom and opening in an outer peripheral surface of said first retainer member, through which portion a corresponding one of said piston rods engaging a corresponding one of said slipper shoes is inserted into said second through bore.

5. The wobble plate piston pump as claimed in claim 1 or claim 2, wherein said second through bores of said first retainer member each have a cut-out portion extending therefrom and opening in an inner peripheral surface of said first retainer member, through which portion a corresponding one of said piston rods engaging a corresponding one of said slipper shoes is inserted into said second through bore.

6. In a wobble plate piston pump including a housing, a drive shaft rotatably mounted in said housing, a cylinder block disposed in said housing and formed therein with a plurality of cylinders circumferentially arranged around said drive shaft, and extending substantially parallel to the axis of said drive shaft, pistons received in said cylinders for reciprocating motions therein, piston rods secured integrally to said pistons, a wobble plate having a central through bore through which said drive shaft extends, said wobble plate being rotatable in unison with rotation of said drive shaft and tiltable relative to said drive shaft, slipper shoes each having a flanged portion disposed in slidable contact or close proximity with a side surface of said wobble plate and a trunk portion engaging a corresponding one of said piston rods, and means for holding said slipper shoes in slidable contact or close proximity with said wobble plate, the improvement comprising in said slipper shoe holding means: a first retainer member in the form of an annular plate, having a first through bore formed in a central portion thereof, and a plurality of second through bores circumferentially arranged in the vicinity of an outer periphery thereof, each being slightly larger in diameter than said trunk portions of said slipper shoes, said first retainer member being loosely fitted at said first through bore on said drive shaft, said second through bores loosely receiving therethrough respective ones of said trunk portions of said slipper shoes, whereby said first retainer member is movable in directions substantially parallel to said sliding side surface of said wobble plate as said slipper shoes slidingly move on or in close proximity to said wobble plate, each of said second through bores each having a cut-out portion opening in an inner peripheral surface of said first retainer member, through which portion a corresponding one of said piston rods engaging a corresponding one of said slipper shoes is inserted into said second through bore, and a second retainer member having an axially extending tubular portion loosely fitted through said first through bore in said first retainer member and unremovably fitted in said central through bore of said wobble plate, and a radially flanged portion formed integrally with said hollow tubular portion and having an outer diameter larger than that of said first through bore of said retainer member but so small that said flanged portion of said second retainer member does not interfere with the sliding movement of said slipper shoes on said wobble plate, said second retainer member holding at said flanged portion thereof said first retainer member in slidable contact or close proximity with said flanged portions of said slipper shoes to enable said first retainer member to keep said flanged portions of said slipper shoes in slidable contact or close proximity with said sliding side surface of said wobble plate.

* * * * *